US008615179B2

(12) United States Patent
Yamaguchi et al.

(10) Patent No.: US 8,615,179 B2
(45) Date of Patent: Dec. 24, 2013

(54) FIXING DEVICE AND IMAGE FORMING APPARATUS HAVING THE SAME

(75) Inventors: Atsushi Yamaguchi, Tahara (JP); Seiichi Kirikubo, Toyokawa (JP); Akihiro Hayashi, Okazaki (JP); Yutaka Yamamoto, Shinshiro (JP); Naoto Sugaya, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 805 days.

(21) Appl. No.: 12/698,383

(22) Filed: Feb. 2, 2010

(65) Prior Publication Data

US 2010/0196038 A1 Aug. 5, 2010

(30) Foreign Application Priority Data

Feb. 5, 2009 (JP) ..... 2009-24999

(51) Int. Cl.
*G03G 15/20* (2006.01)

(52) U.S. Cl.
USPC ..... 399/69; 399/330; 399/335

(58) Field of Classification Search
USPC ..... 399/69, 330, 335
See application file for complete search history.

(56) References Cited

U.S. PATENT DOCUMENTS

| | | | | |
|---|---|---|---|---|
| 6,985,680 | B2 * | 1/2006 | Sakai et al. | 399/50 |
| 7,254,353 | B2 * | 8/2007 | Koyama et al. | 399/69 |
| 2003/0155349 | A1 * | 8/2003 | Matsuo et al. | 219/664 |
| 2005/0169658 | A1 * | 8/2005 | Hanamoto et al. | 399/88 |
| 2006/0083530 | A1 * | 4/2006 | Bartley et al. | 399/70 |
| 2006/0093388 | A1 * | 5/2006 | Kawazu et al. | 399/69 |
| 2006/0131301 | A1 * | 6/2006 | Ohta et al. | 219/619 |
| 2007/0201913 | A1 | 8/2007 | Kamoda | |
| 2007/0230981 | A1 * | 10/2007 | Cho | 399/69 |

(Continued)

FOREIGN PATENT DOCUMENTS

| | | | |
|---|---|---|---|
| JP | 09022225 A | * | 1/1997 |
| JP | 09-062375 | | 3/1997 |

(Continued)

OTHER PUBLICATIONS

"Basic Electronics Tutorials" by Wayne Storr, Copyright © 1999-2012.*

(Continued)

*Primary Examiner* — Walter L Lindsay, Jr.
*Assistant Examiner* — David Bolduc
(74) *Attorney, Agent, or Firm* — Buchanan Ingersoll & Rooney PC

(57) ABSTRACT

While a recording sheet is passing through a fixing nip formed between a heating roller 41 having a heating layer and a pressing roller 42 pressed against the roller 41, a coil 43 is exited by high-frequency power from a power source and causes the layer to generate heat. An unfixed image on the recording sheet is fixed by the heat. The power source detects a zero cross timing of a rectified alternating current, detects an instantaneous value at a point a predetermined period after the zero cross timing, calculates an effective power of the alternating current based on the instantaneous value, and controls the output power to be a desired value determined based on the effective power and the surface temperature of the roller 41. Thus power input to the power source can be quickly detected and power output to the coil can be quickly and stably controlled.

13 Claims, 10 Drawing Sheets

(56) References Cited

U.S. PATENT DOCUMENTS

| | | | | |
|---|---|---|---|---|
| 2008/0025745 | A1* | 1/2008 | Shin et al. | 399/69 |
| 2009/0003868 | A1* | 1/2009 | Namiki et al. | 399/69 |
| 2009/0060551 | A1* | 3/2009 | Lee et al. | 399/70 |

FOREIGN PATENT DOCUMENTS

| | | | |
|---|---|---|---|
| JP | 10-301442 | | 11/1998 |
| JP | 2002-237377 | A | 8/2002 |
| JP | 2003-098860 | | 4/2003 |
| JP | 2003-297542 | A | 10/2003 |
| JP | 2005-190765 | | 7/2005 |
| JP | 2005-221677 | | 8/2005 |
| JP | 2006-171629 | | 6/2006 |

OTHER PUBLICATIONS

Office Action (Notification of Reasons for Refusal) dated Jan. 18, 2011, issued in the corresponds to Japanese Patent Application No. 2009-024999, and an English Translation thereof.

Office Action (Decision to Grant a Patent) dated Sep. 6, 2011, issued in the corresponding Japanese Patent Application No. 2009-024999, and an English Translation thereof.

* cited by examiner

FIG. 12

Apparatus condition table

| | Apparatus conditions | Timer coefficients |
|---|---|---|
| Environmental factors | Fixing temperature<Ta | Na |
| | Ta≦Fixing temperature<Tb | Nb |
| | Tb≦Fixing temperature<Tc | Nc |
| | Tc≦Fixing temperature | Nd |
| Temperature-adjustment factors | Fixing power change<Qa | Ma |
| | Qa≦Fixing power change<Qb | Mb |
| | Qb≦Fixing power change<Qc | Mc |
| | Qc≦Fixing power change | Md |

$n = Nx \times Mx$

FIG. 13

Prior Art

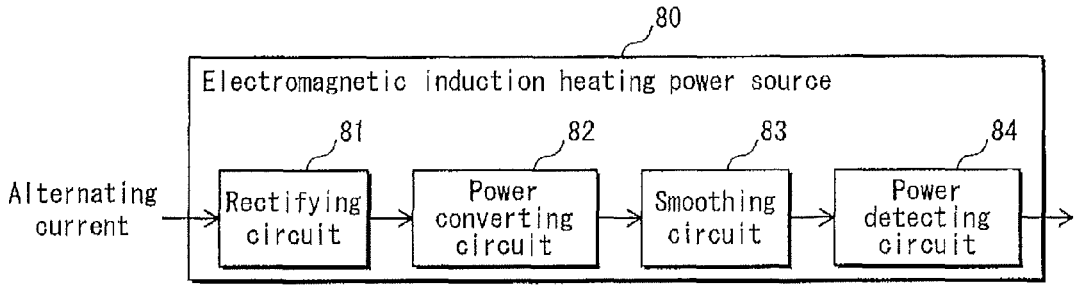

FIXING DEVICE AND IMAGE FORMING APPARATUS HAVING THE SAME

This application is based on an application No. 2009-24999 filed in Japan, the contents of which are hereby incorporated by reference.

BACKGROUND OF THE INVENTION (1) Field of the Invention

The present invention relates to a fixing device that uses an electromagnetic induction heating technology, and an image forming apparatus having the fixing device.

(2) Description of the Related Art

A fixing device provided in image forming apparatuses such as printers forms a fixing nip by pressing a heating roller or a heating belt and a pressure roller or a pressure belt against each other. Such a fixing device generally fixes a toner image formed on a recording sheet by applying heat and pressure to the toner image while the recording sheet is passing through the fixing nip with the heating roller or the heating belt heated by the heat source.

Conventionally, a halogen heater is commonly used as the heat source for the fixing device. However, in recent years, an electromagnetic induction heating technology has been attracting attention as it realizes more rapid and efficient heating than with a halogen heater and leads to energy saving. One example of the electromagnetic induction heating technology uses a heating belt having an electromagnetic induction heating layer, which is to be caused to generate heat with an electromagnetic induction coil provided outside the area in which the heating belt rotates.

A fixing device having a heating belt that uses the electromagnetic induction heating technology is provided with an induction heating power source circuit. The induction heating power source circuit is used for converting an alternating current for commercial use into a high-frequency current that resonates with an electromagnetic induction coil by using a capacitor. A high-frequency current output from the induction heating power source circuit is supplied to the electromagnetic induction coil, which causes the heating layer provided on the heating belt to generate heat. The induction heating power source circuit converts an input alternating current (50 Hz or 60 Hz) to a high-frequency current by rectifying the alternating current and performing switching with use of a switching device. Such a fixing device is capable of minimizing the thermal capacity and securing a desired temperature-rising characteristic.

A Patent Document 1 (Japanese Patent Application Publication No. 2002-237377) discloses a structure of a fixing device using the electromagnetic induction heating technology, conceived for preventing the occurrence of an ineffective current due to the phase difference between a commercial-use alternating current and a consumption current. To fulfill the purpose, the fixing device controls the turn-on time of the switching device based on a current obtained from a voltage detected between the electromagnetic induction coil and the switching device.

According to the structure disclosed in the Patent Document 1, the fixing device directly uses a pulsating current resultant from rectification of an alternating current having a frequency of 50 Hz or 60 Hz. That is, the induction heating power source circuit is not provided with a smoothing capacitor for suppressing harmonics contained in the current input to the induction heating power source circuit. Thus, the high-frequency current to be output has a frequency of 100 Hz or 120 Hz, and is subject to significant fluctuations in electrical power. Furthermore, the high-frequency electrical power is to be output with a low power factor because it is to be applied to a resonant circuit including an electromagnetic induction coil (i.e. inductor) and a resonant capacitor. This means that it is not easy to accurately detect the electrical power output from the induction heating power source.

To enable the induction heating power source to accurately output high-frequency electrical power having a predetermined value, the high-frequency electrical power is detected from the electrical power based on the alternating current input to the induction heating power source. FIG. 13 shows an example of such an induction heating power source. The induction heating power source 80 is configured as follows: first, a rectifying circuit 81 rectifies an input alternating current; second, an power converting circuit 82 converts the electrical power of a direct current resultant from the rectification to a predetermined power level; then a smoothing circuit 83 smoothes the direct current; and finally, an electrical power detecting circuit 84 detects the value of the electrical power based on the smoothed current.

For example, when the alternating current input to the induction heating power source 80 has a frequency of 50 Hz (20 ms per cycle), the electrical power of the direct current, resultant from full-wave rectification by the rectifying circuit 81, is converted by the power converting circuit 82 to be at a predetermined power level, as shown in FIG. 14A. Through the full-wave rectification by the rectifying circuit 81, the negative half of the sine wave of the input alternating current is converted to have positive polarity. After the power conversion, the direct current is smoothed by the smoothing circuit 83 to have a predetermined output level, as shown in FIG. 14B. The electrical power detecting circuit 84 detects the output level after the smoothing.

With the induction heating power source 80 having such a structure, the smoothing circuit 83 might not be able to perform sufficient smoothing when its time constant is small. Asa result, the output electrical power might fluctuate, and the detection accuracy of the electric power detecting circuit 84 might degrade. Although it is possible to suppress the fluctuation of the output electrical power from the smoothing circuit 83 by increasing the time constant of the smoothing circuit 83, this also increases the time required for the smoothing. As a result, the period from the inputting of the alternating current into the induction heating power source 80 to the detection of the power level by the electrical power detecting circuit 84 will be increased. This is problematic.

Besides, in detection by the electrical power detecting circuit 84 of one cycle (e.g. 20 ms) of the alternating current input to the induction heating power source 80, it is common that a delay due to a capacitor on the electrical power detecting circuit 84 is taken into consideration. Thus, for example, the electrical power detecting circuit 84 detects the output power with a delay of at least 10 ms. This also increases the time required for the power detection.

For use with a fixing device of an image forming apparatus, a heating belt is more preferable than a heating roller, because a heating belt has a lower thermal capacity and a better temperature-rising characteristic. However, when a heating belt having a low thermal capacity is used, the temperature greatly changes in response to changes of the electrical power. Thus it is necessary to quickly control the electrical power applied to the electromagnetic induction coil in response to the changes of the fixing temperature of the heating belt. In view of this, high-speed control of the electrical power has been conventionally performed with use of a temperature detecting device that is capable of detecting the temperature in a short time. However, even with use of such a temperature detecting device, response delay of the electrical power control might occur if the detection of the power takes a long time. As a result, it might become impossible to quickly set the temperature of the heating belt to be a desired fixing temperature.

SUMMARY OF THE INVENTION

The present invention is made in view of the problems stated above. The object of the present invention is to provide a fixing device that is capable of performing high-speed electrical power control in response to changes of the temperature of a heating layer by quickly performing electrical power detection in an induction heating power source, and an image forming apparatus having the fixing device.

To achieve the object, one aspect of the present invention provides a fixing device for fixing an unfixed image formed on a recording sheet by causing an electromagnetic heating layer of a first roller to generate heat by using a magnetic flux generated from an electromagnetic induction coil and applying the generated heat to the unfixed image while the recording sheet is passing through a fixing nip formed between the first roller and a second roller pressed against the first roller, the fixing device comprising: an electromagnetic induction heating power source operable to generate high-frequency power by rectifying a commercial-use alternating current and performing high-speed switching on the rectified current by using a switcher, and to output the high-frequency power to the electromagnetic induction coil; a temperature detector operable to detect a surface temperature of the first roller; and an output power determiner operable to determine a desired value of the high-frequency power based on the surface temperature detected by the temperature detector, wherein the electromagnetic induction heating power source includes: a power detector operable to detect information relating to the alternating current based on an instantaneous power value of the alternating current measured at a time point that is a predetermined period after a zero cross timing of power of the alternating current; and an induction heating power source controller operable to control the switcher based on the information detected by the power detector, such that the high-frequency power has the desired value.

Another aspect of the present invention provides an image forming apparatus for fixing an unfixed image formed on a recording sheet by applying heat to the unfixed image by using a fixing part, comprising the above-mentioned fixing device as the fixing part.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 12 shows an example of an apparatus condition table used for generation of a control signal performed by the induction heating power control unit;

FIG. 13 is a block diagram showing a structure for detection of an alternating current input to a conventional electromagnetic induction heating power source;

DESCRIPTION OF THE PREFERRED EMBODIMENTS

Figure 1:
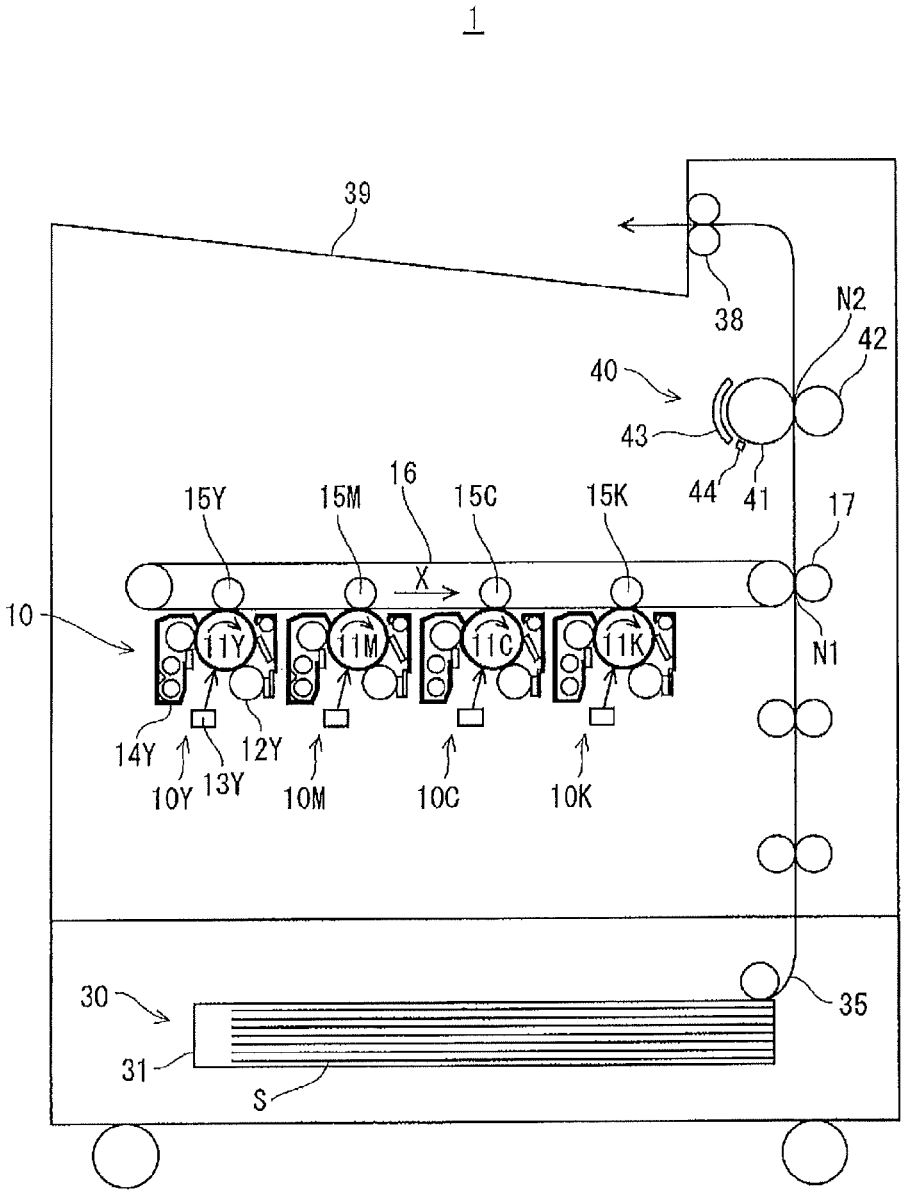
FIG. 1 is a schematic diagram showing an overall structure of a tandem-type color printer equipped with a fixing device pertaining to an embodiment of the present invention.

The following describes embodiments of a fixing device and an image forming apparatus pertaining to the present invention, based on an example of a tandem-type color digital printer (hereinafter simply referred to as a "printer"). FIG. 1 is a schematic diagram showing an overall structure of a printer 1. As FIG. 1 shows, the printer 1 forms images by a known electrophotographic method. The printer 1 includes an image processor 10, a sheet conveyer 30, and a fixing device 40. The image processor 10 forms a toner image. The sheet conveyer 30 conveys a recording sheet S onto which the toner image is to be transferred. The fixing device 40 fixes the toner image, which has been transferred onto the recording sheet S, to the recording sheet S. Upon receiving an instruction to execute printing (a print job) from an external terminal apparatus (not depicted) connected to a network (such as an intra-office LAN), the printer 1 forms a color toner image on a recording sheet S in accordance with the instruction, the color toner image being composed of colors yellow (Y), magenta (M), cyan (C), and black (K).

The image processor 10 includes image forming units 10Y, 10M, 10C, and 10K corresponding to the colors Y, M, C and K respectively, and an intermediate transfer belt 16 onto which toner images formed by the image forming units 10Y, 10M, 10C, and 10K are to be transferred. The intermediate transfer belt 16 is horizontally suspended in a tensioned state, substantially at the center in the vertical direction of the printer 1. The intermediate transfer belt 16 is rotated in the direction of arrow X. The image forming units 10Y, 10M, 10C, and 10K are disposed below the intermediate transfer belt 16 along the rotating direction of the intermediate transfer belt 16, in the stated order from the upstream of the intermediate transfer belt 16.

The image forming unit 10Y for forming a Y-color toner image includes a photoreceptor drum 11Y, and a charger 12Y, an exposure 13Y, and a developer 14Y disposed surrounding the photoreceptor drum 11Y. The image former 10Y forms a Y-color toner image on the photoreceptor drum 11Y by sequentially performing known processing procedures of charging, exposing, and developing. Other image forming units 10M, 100 and 10K also have similar structures to the image former 10Y, and respectively form M-, C- and K-color toner images on the photoreceptor drums 11M, 11C and 11K.

The toner images respectively formed on the photoreceptor drums 11Y, 11M, 11C and 11K are transferred by primary transfer rollers 15Y, 15M, 15C and 15K onto a transfer area on the intermediate transfer belt 16 so as to form multiple layers. The primary transfer rollers 15Y, 15M, 15C and 15K respectively oppose the photoreceptor drums 11Y, 11M, 11C and 11K via the intermediate transfer belt 16. A secondary transfer roller 17 is, disposed at one end of the intermediate transfer belt 16 near the image forming unit 10K so as to oppose the intermediate transfer belt 16, and a transfer nip N1 is formed between therebetween.

The sheet conveyer 30 includes a sheet supply cassette 31 provided below the image processor 10. In execution of a print job, recording sheets S housed in the sheet supply cassette 31 are pulled out onto a conveyance path 35 one by one. The conveyance path 35 runs through the transfer nip N1 between the intermediate transfer belt 16 and the secondary transfer roller 17. Onto a recording sheet S pulled out onto the conveyance path 35, the multilayered toner image transferred onto the intermediate transfer belt 16 are transferred while the recording sheet S is passing through the transfer nip N1. After that, the recording sheet S is conveyed to the fixing device 40 provided above the transfer nip N1.

In the fixing device 40, the recording sheet S conveyed on the conveyance path 35 is heated according to an electromagnetic induction heating technology. The toner image is pressed against the recording sheet S so that the toner image is fixed onto the recording sheet S. The recording sheet S with the fixed toner image is discharged by a pair of sheet discharge rollers 38 onto a discharge tray 39.

Figure 2:
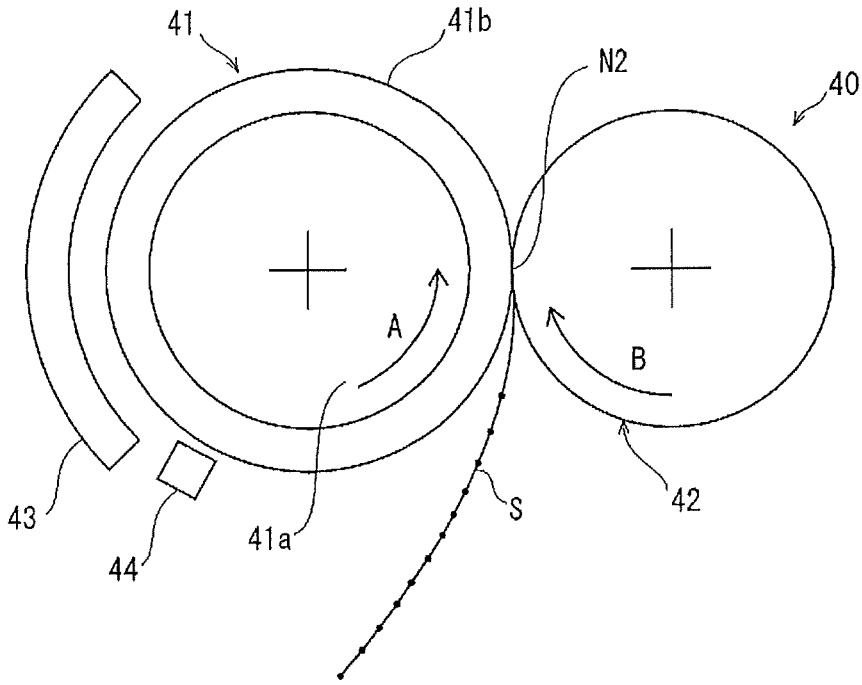
FIG. 2 is a schematic diagram showing the structure of the fixing device shown in FIG. 1.

FIG. 2 is a sectional view showing the structure of the fixing device 40. The fixing device 40 includes a heating roller 41 as a first roller, a pressing roller 42 as a second roller, and an electromagnetic induction coil 43 used for heating the heating roller 41. The heating roller 41 includes a roller body 41*a* and a heated member 41*b* provided on the surface of the roller body 41*a*. The heated member 41*b* has an electromagnetic induction heating layer which is caused to generate heat by a magnetic flux of a magnetic field generated by the electromagnetic induction coil 43.

The ends of the heating roller 41 and the pressing roller 42 are rotably held by bearings of a frame (not depicted) respectively. The heating roller 41 and the pressing roller 42 are pressed against each other so that a fixing nip N2 is formed therebetween. A recording sheet S passes through the fixing nip N2. The pressing roller 42 is rotated in the direction of an arrow B by driving force from a driving motor (not depicted). The heating roller 41 is driven by the pressing roller 42, and accordingly rotates in the direction of an arrow A.

The electromagnetic induction coil 43 is provided along the outer surface of the heating roller 41 so as to cover almost halfway around the heating roller 31 on the side opposite to the heating roller 42. Receiving high-frequency electrical power from an electromagnetic induction heating power source 60 described below (see FIG. 3), the electromagnetic induction coil 43 generates a high-frequency magnetic field. The electromagnetic induction heating layer of the heated member 41*b* provided on the heating roller 41 is caused to generate heat by magnetic flux of the high-frequency magnetic field. A fixing temperature sensor 44 that detects the surface temperature of the heating roller 41 is provided downstream from the electromagnetic induction coil 43 in the rotation direction of the heating roller 41, so as to oppose the heating roller 41.

Figure 3:
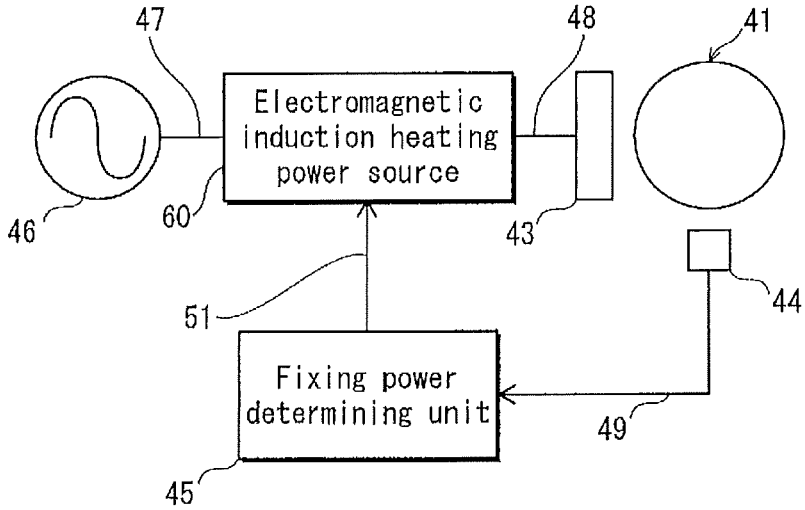
FIG. 3 is a block diagram showing the structure of a control system of an electromagnetic induction coil provided in the fixing device shown in FIG. 2.

FIG. 3 is a block diagram showing the structure of a control system of the electromagnetic induction coil 43 provided in the fixing device 40. The electromagnetic induction coil 43 is configured such that a high-frequency electrical power output from the electromagnetic induction heating power source 60 is applied thereto via a high-frequency electrical power supply path 48.

An alternating current having a frequency of 50 Hz or 60 Hz, supplied from a commercial-use alternating current source 46, is input to the electromagnetic induction heating power source 60 via an alternating current supply path 47. The electromagnetic induction heating power source 60 controls the input alternating current to be a high-frequency current having a predetermined electrical power, and outputs the high-frequency current to the electromagnetic induction coil 43 via the high-frequency electrical power supply path 48.

An output from the fixing temperature sensor 44 is supplied to a fixing power determining unit 45 via a sensor output supply path 49. The fixing power determining unit 45 generates a power control signal based on the temperature detected by the fixing temperature sensor 44 and input to the fixing power determining unit 45 via the sensor output supply path 49, and supplies the signal to the electromagnetic induction heating power source 60 via a power control signal supply path 51, such that the high-frequency current output from the electromagnetic induction heating power source 60 to the electromagnetic induction coil 43 has a predetermined power value (i.e. an effective power value).

Figure 4:
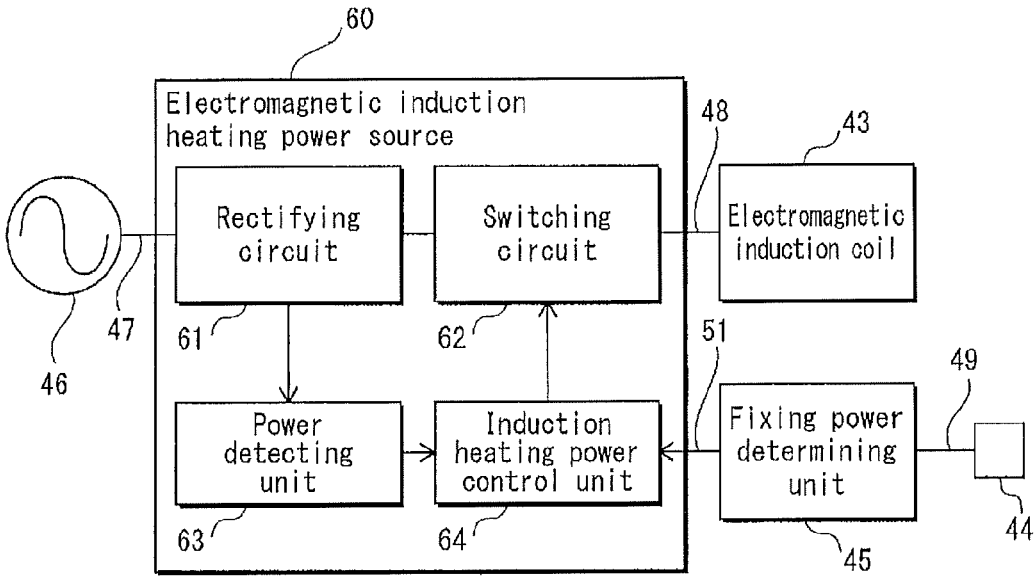
FIG. 4 is a block diagram showing a specific structure of an electromagnetic induction heating power source provided in the control system shown in FIG. 3.

FIG. 4 is a block diagram showing a specific structure of the electromagnetic induction heating power source 60. The electromagnetic induction heating power source 60 includes a rectifying circuit 61, a switching circuit 62, a power detecting unit 63, and an induction heating power control unit 64. The rectifying circuit 61 rectifies an alternating current having a frequency of 50 Hz or 60 Hz, which is input from the alternating current source 46 via the alternating current supply path 47. The switching circuit 62 performs high-speed switching to convert the direct current, which is resultant from the rectification by the rectifying circuit 61, into a high-frequency current. The power detecting unit 63 calculates the effective power value, which is the desired electrical power value of the high-frequency current output from the switching circuit 62 based on the direct current output from the rectifying circuit 61. The induction heating power control unit 64 controls the switching circuit 62 based on the effective power value (setting power value) calculated by the power detecting unit 63 and the power control signal output from the fixing power determining unit 45, such that the high-frequency current output from the switching circuit 62 has the effective power value.

Figure 5A:
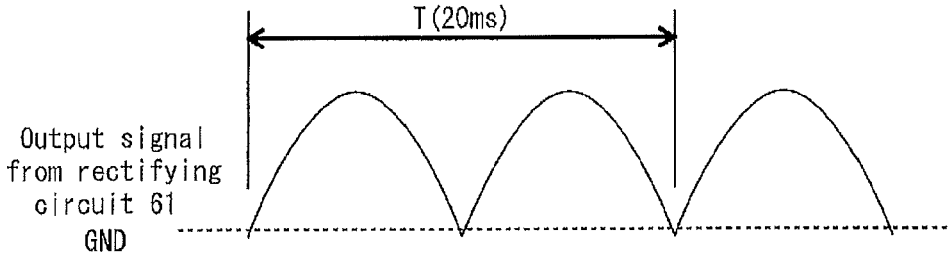
FIG. 5A is a diagram for explaining a direct current output from a rectifying circuit provided in the electromagnetic induction heating power source.

The rectifying circuit 61 includes a rectifying device with a small time constant, such as a diode. As shown in FIG. 5A, the rectifying circuit 61 performs full-wave rectification on the sine wave of the alternating current output from the alternating current source 46. That is, the rectifying circuit 61 converts the negative half of the sine wave of the input alternating current to have positive polarity. One cycle T of the sine wave of a 50 Hz alternating current is 20 ms. The power detecting unit 63 calculates the effective power value of the input power based on an instantaneous value of the power of the direct current resultant from the full-wave rectification by the rectifying circuit 61 measured after the elapse of a predetermined period of time. The power detecting unit 63 outputs the obtained effective power value to the induction heating power control unit 64.

Figure 5B:
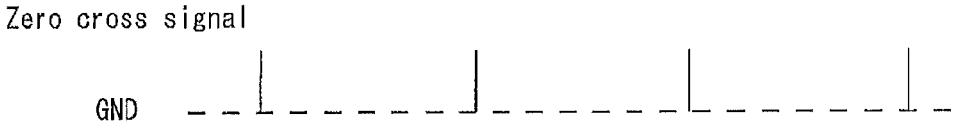
FIG. 5B is a diagram for explaining an output signal from a zero cross detecting circuit provided in the electromagnetic induction heating power source.
Figure 6:
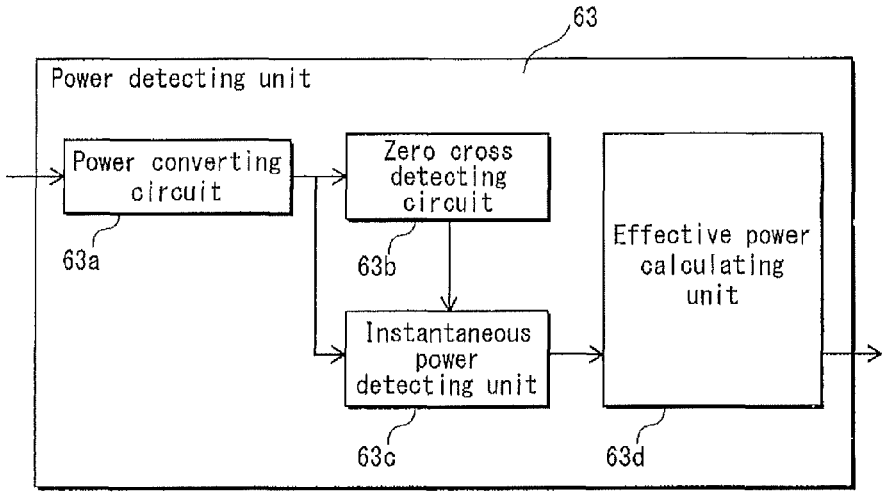
FIG. 6 is a block diagram showing a specific structure of a power, detecting unit provided in the electromagnetic induction heating power source.

FIG. 6 is a block diagram showing a specific structure of the power detecting unit 63. The power detecting unit 63 includes a power converting circuit 63*a*, a zero cross detecting circuit 63*b*, an instantaneous power detecting unit 63*c* and an effective power calculating unit 63*d*. The power converting circuit 63*a* converts the power of the full-wave-rectified current supplied by the rectifying circuit 61 to be at a predetermined detection level. The zero cross detecting circuit 63*b* detects a ground-level timing in a direct current output from the power converting circuit 63*a*, which has the waveform shown in FIG. 5A. As shown in FIG. 5B, the ground-level timing is a timing at which the power of the alternating current input from the electromagnetic induction heating power source 60 is at the ground level (zero level). The zero cross detecting circuit 63*b* outputs a zero cross signal at the detected timing. The instantaneous power detecting unit 63*c* detects an instantaneous value of the power output from the power converting circuit 63*a* after the elapse of a predetermined period of time from the output of the zero cross signal, based on the power output from the power converting circuit 63*a* and the zero cross signal output from the zero cross detecting circuit 63 *b*. The effective power calculating unit 63*d* calculates the effective power value of the alternating current based on the instantaneous value detected by the instantaneous power detecting unit 63*c*.

The instantaneous power detecting unit 63*c* and the effective power calculating unit 63*d* consist of a CPU, for example. The power converting circuit 63*a* converts the power output from the rectifying circuit 61 to be at a level processable by the instantaneous power detecting unit 63*c* and the effective power calculating unit 63*d* consist of a CPU.

Figure 7:
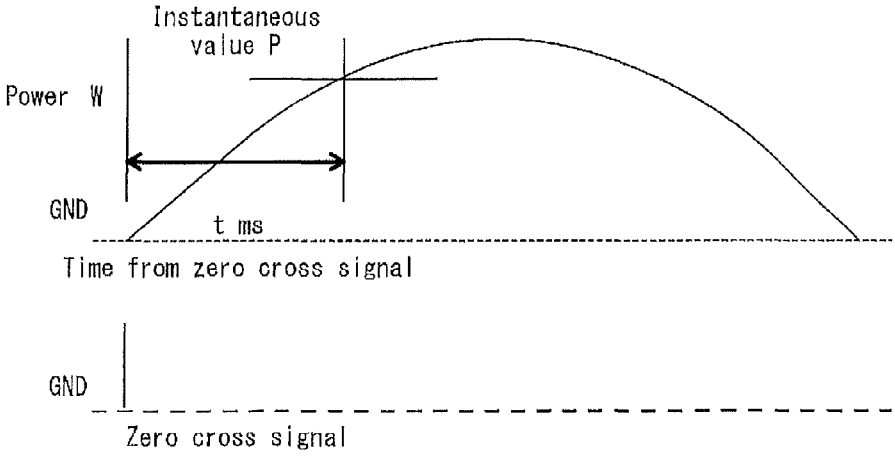
FIG. 7 is a diagram for explaining an instantaneous value detected by an effective power calculating unit provided in the electromagnetic induction heating power source.

FIG. 7 is a diagram for explaining an instantaneous value detected by the instantaneous power detecting unit 63*c*. The instantaneous power detecting unit 63*c* is beforehand provided with a timing for detecting the instantaneous value in response to the zero cross signal. For example, the instantaneous power detecting unit 63*c* detects an instantaneous value P (W) of the power output from the power converting circuit 63*a* after the elapse of a predetermined time t (ms) from the output of the zero cross signal. It is preferable that the predetermined time t (ms) is, for example, a quarter of the cycle T (i.e. T/4) of the alternating current input to the electromagnetic induction heating power source 60. This is because the sine wave of the alternating current is at the maximum power level at a time point that is T/4 after the output of the zero cross signal. Furthermore, in the vicinity of the time point, the change in the power level is small. Thus, an error of the instantaneous value to be detected will be minor, and the instantaneous value will be detected accurately.

Note that the structure of the zero cross detecting circuit 63*b* is not limited to that for detecting a zero cross signal base on the power output from the rectifying circuit 61. Alternatively, the zero cross detecting circuit 63*b* may generate a zero cross signal based on the voltage or the current output from the rectifying circuit 61. If this is the case, the instantaneous power detecting unit 63*c* calculates the instantaneous value P based on, the voltage value or the current value detected after the elapse of a predetermined period from the output of the zero cross signal.

Upon detection of the instantaneous value P (W), the instantaneous power detecting unit 63*c* outputs the instantaneous value P to the effective power calculating unit 63*d*. The effective power calculating unit 63*d* calculates an effective power value W0 of the alternating current input to the electromagnetic induction heating power source 60, based on the instantaneous value P. Since the waveform of the alternating current is a sine curve, the effective power value W0 of the alternating current can be obtained as follows. In the following Expression (1), t (ms) is the elapsed time from the output of the generated zero cross signal, and T is a cycle of the alternating current.

$$W0=P/\{\sqrt{2}\times\sin(t\times n/T)\} \quad (1)$$

The Expression (1) can be simplified as follows.

$$W0=k\times P \quad (2)$$

(k is a predetermined coefficient.)

Figure 8:
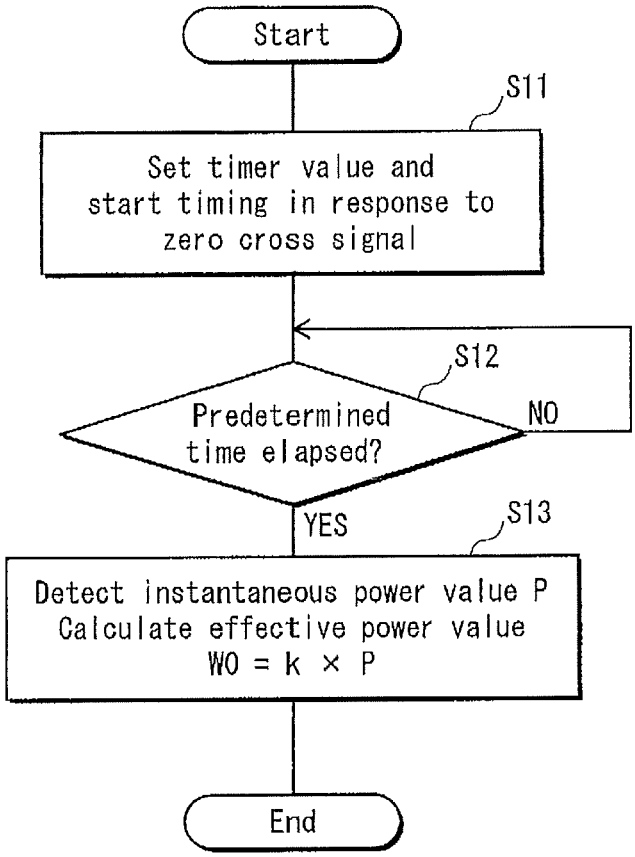
FIG. 8 is a flowchart showing calculation of an instantaneous value performed by the effective power calculating unit.

FIG. 8 is a flowchart showing calculation of the instantaneous value P performed by the effective power calculating unit 63*d*. On receipt of the zero cross signal output from the zero cross detecting circuit 63*b*, the effective power calculating unit 63*d* sets the timer value for an instantaneous power measurement timer to be a predetermined time t (ms), and starts the instantaneous power timer to count the time (Step S11 in FIG. 8). The instantaneous power timer is used for counting the elapsed time from the output of the zero cross signal. Next, when the instantaneous power timer shows the elapse of the predetermined time t (ms) (Step S12), the instantaneous value P (W) at the time t (ms) is detected, and the effective power calculating unit 63*d* calculates the effective power value W0 by the Expression (2) for example, based on the detected instantaneous value P (Step S13). The effective power calculating unit 63*d* calculates the effective power value W0 every time the zero cross detecting circuit 63*b* generates a zero cross signal, by cyclically repeating Steps S11 to S13.

The effective power value W0 of the input alternating current, calculated by the effective power calculating unit 63*d* in the stated manner, is output to the induction heating power control unit 64, as FIG. 4 shows. The induction heating power control unit 64 is also provided with an output (a setting power value W1) from the fixing power determining unit 45, which determines the effective power value (the effective value of the fixing power) as the desired value of the power to be applied to the electromagnetic induction coil 43 based on the fixing temperature detected by the fixing temperature sensor 44.

Figure 9:
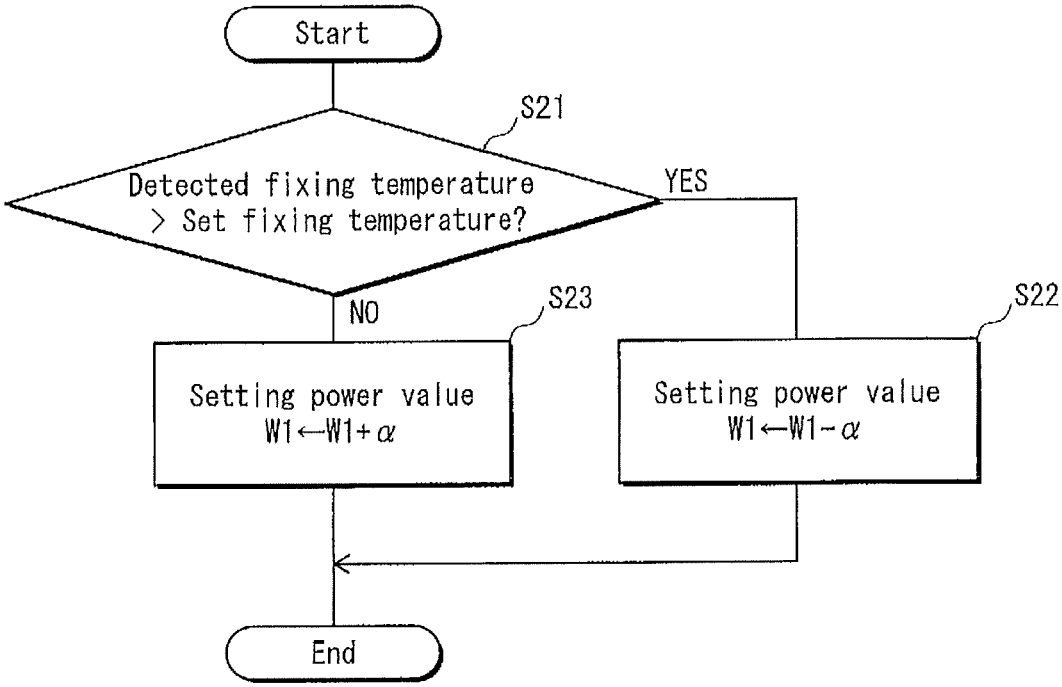
FIG. 9 is a flowchart showing processing for calculation of a setting power value performed by a fixing power determining unit.

FIG. 9 is a flowchart showing processing for determination of the setting power value W1 performed by the fixing power determining unit 45. The fixing power determining unit 45 reads an output signal from the fixing temperature sensor 44 at a predetermined timing. The fixing power determining unit 45 detects the fixing temperature on the surface of the heating roller 41 based on the read output signal, and compares the detected fixing temperature with a setting fixing temperature that has been set in advance (Step S21 in FIG. 9). As a result of the comparison, if the fixing temperature is higher than the setting fixing temperature (YES in Step S21), the fixing power determining unit 45 updates the setting power value W1 that is a desired power output from the switching circuit 62, by subtracting a required variable amount a from the setting power value W1 (i.e. W1−α), based on the difference between the detected fixing temperature and the setting fixing temperature (Step S22).

On the other hand, if the fixing temperature is not higher than the setting fixing temperature (NO in Step S21), the fixing power determining unit 45 updates the setting power value W1 that is a desired power output from the switching circuit 62, by adding a required variable amount α to the setting power value W1 (i.e. W1+α), based on the difference between the detected fixing temperature and the setting fixing temperature (Step S23). The fixing power determining unit 45 outputs the setting power value W1 determined as described above to the induction heating power control unit 64. Note that the variable amount α is set beforehand in correspondence with the values of the difference between the detected fixing temperature and the setting fixing temperature. The induction heating power control unit 64 outputs a control signal to the switching circuit 62, based on the setting power value W1 output from the fixing power determining unit 45 and the effective power value W0 output from the effective power calculating unit 63*d*. The control signal is used for controlling the ON-OFF timing of a switching device included in the switching circuit 62.

Figure 10:
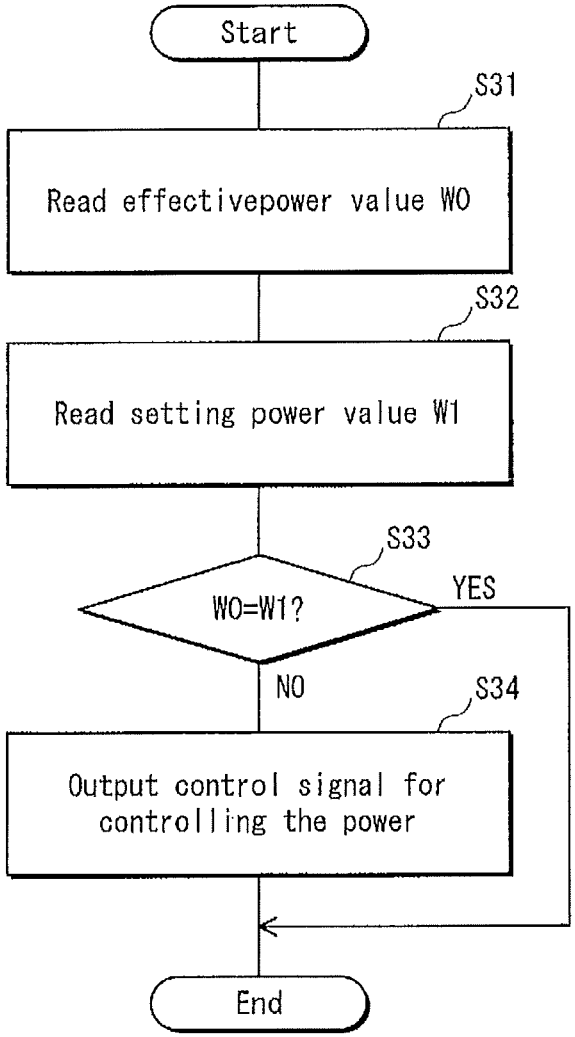
FIG. 10 is a flowchart showing processing for generation of a control signal performed by an induction heating power control unit.

FIG. 10 is a flowchart showing processing for generation of the control signal performed by the induction heating power control unit 64. The induction heating power control unit 64 reads the effective power value W0 output from the effective power calculating unit 63*d* (Step S31 in FIG. 10). Also, the induction heating power control unit 64 reads the setting power value W1 output from the fixing power determining unit 45 (Step S32). The induction heating power control unit 64 compares the effective power value W0 with the setting power value W1 (S33). If the effective power value W0 is not the same as the setting power value W1 (NO in step S33), the induction heating power control unit 64 generates a control signal for adjusting the power to be output from the switching circuit 62, based on the difference between the effective power value W0 and the setting power value W1 as the desired value, and outputs the generated control signal to the switching circuit 62 (Step S34).

The control signal is generated based on an effective power required for resolving the difference between the effective power value W0 and the setting power value W1 as the desired value. If the effective power value W0 is the same as the setting power value W1 (YES in Step S33), the induction heating power control unit 64 completes the processing without outputting the control signal for adjusting the power to be output from the switching circuit 62.

In the switching circuit 62, the ON-OFF timing of the switching device is controlled based on the control signal output from the effective power calculating unit 63*d*. As a result, a high-frequency power having the effective power value that has been set as the desired value is generated, and is applied to the electromagnetic induction coil 43. The electromagnetic induction coil 43 is caused to generate a high-frequency magnetic field by being applied the high-frequency power having the predetermined effective power value output from the switching circuit 62. Due to the magnetic flux of the generated magnetic field, the electromagnetic induction heating layer of the heating roller 41 generates heat. As a result, the surface of the heating roller 41 has the fixing temperature that has been set.

According to this embodiment, the effective power value of the alternating current input to the electromagnetic induction heating power source 60 is calculated after the rectification of the alternating current, based on the instantaneous value measured after the elapse of a predetermined time from the output of the zero cross signal. Thus, it is unnecessary to smooth the direct current resultant from the rectification, and it is possible to quickly calculate the effective power value of the input alternating current. Since the power output from the electromagnetic induction heatingpower source 60 is controlled based on the calculated effective power value, the power control can be performed each time a zero cross signal is generated. Zero cross signals are usually generated in cycles of approximately 10 ms. Thus, it is possible to immediately control the fixing temperature of the heating roller 41 to be the predetermined temperature in response to changes of the fixing temperature detected by the temperature sensor without delay.

Here, note that not only the fixing device 40 of the image processor 10, but also the image forming units 10Y, 10M, 10C and 10K included in the image processor 10 consume the power. In addition to the image processor 10, the sheet conveyer 30 consumes the power. Furthermore, in the fixing device 40, driving parts other than the electromagnetic induction coil 43 consume the power. Thus, the alternating current input to the electromagnetic induction heating power source 60 might be distorted due to the power changes in the power-consuming parts other than the electromagnetic induction coil 43.

For example, in the fixing device 40, when heating with a halogen heater is adopted together with the electromagnetic induction heating, there is a possibility that the waveform will be distorted due to voltage changes of the alternating current input to the electromagnetic induction heating power source 60 when, for example, the consumption power is changed by turning on or turning off of the halogen heater, changes of the power level, and so on. Also, in the case of performing phase-control of the halogen heater, the waveform of the alternating current input to the electromagnetic induction heating power source 60 might be deviated from the sine-wave pattern. Moreover, the waveform of the alternating current input to the electromagnetic induction heating power source 60 might be distorted due to changes of the voltage caused by turning on of an external device driven with an alternating current output from the alternating current source 46.

To realize accurate calculation of the effective power value of the alternating current input to the electromagnetic induction heating power source 60 even in the above-mentioned cases, the effective power value, which is calculated based on the instantaneous value P, may be calculated continuously in a predetermined period or be calculated for multiple times, and a plurality of instantaneous values P resultant from the calculation may be averaged.

Figure 11:
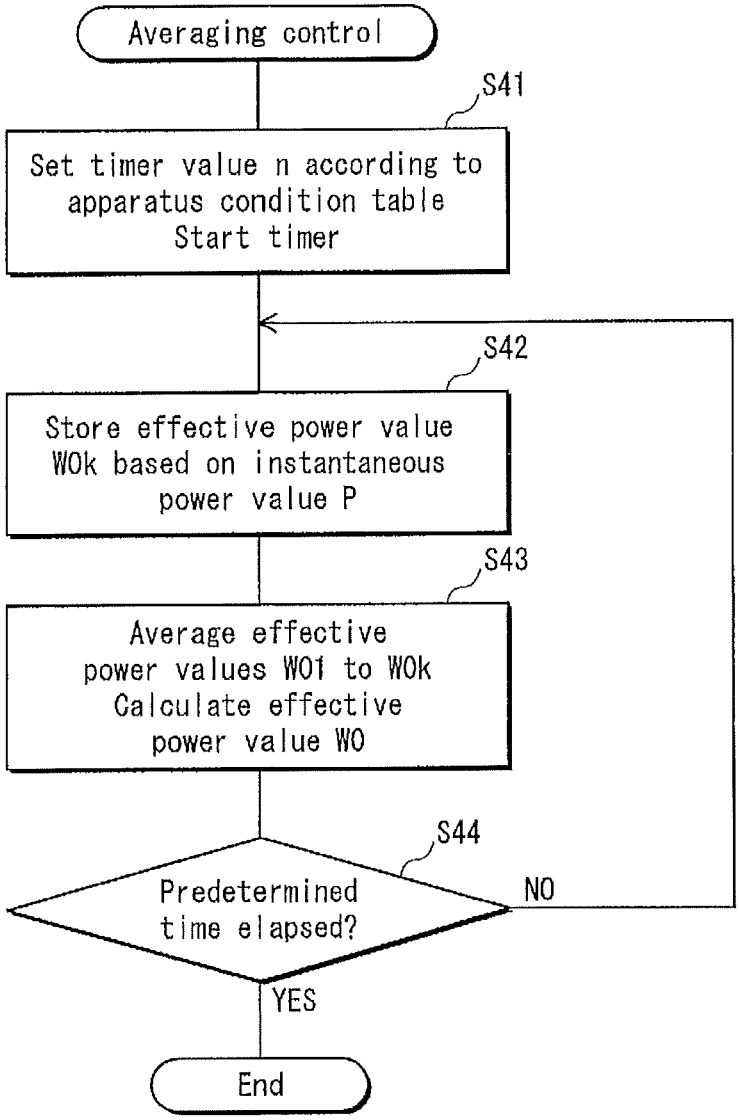
FIG. 11 is a flowchart showing averaging of effective power values performed by the induction heating power control unit.
Figure 14A:
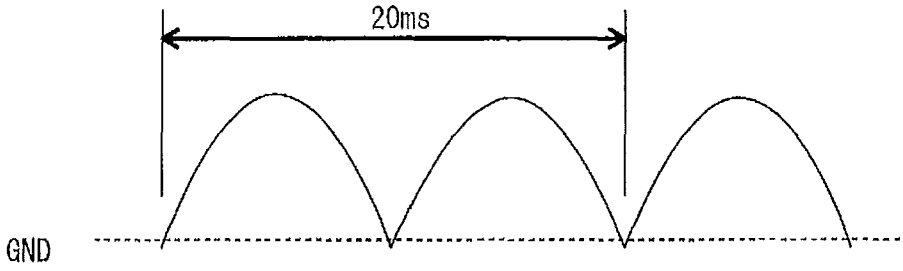
FIG. 14A Prior Art
FIG. 14A is a diagram for explaining a direct current output from a rectifying circuit provided for detection of an alternating current.
Figure 14B:
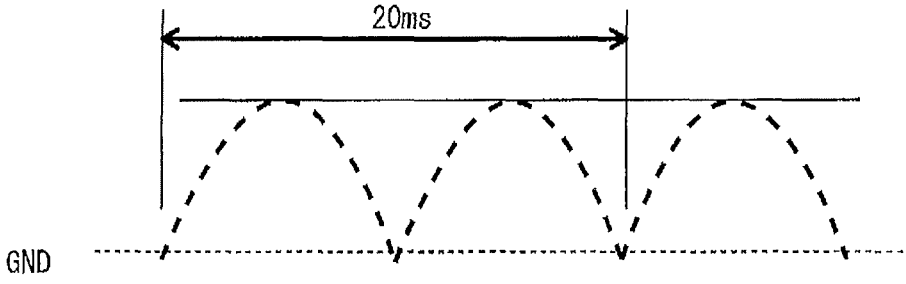
FIG. 14B Prior Art
FIG. 14B is a diagram for explaining an output signal from a smoothing circuit.

FIG. 11 is a flowchart showing the averaging of the effective power values, performed by the induction heating power control unit 64. First, the induction heating power control unit 64 sets a timer value n based on an apparatus condition table shown in FIG. 12. The timer value n defines the execution time of the averaging processing. The induction heating power control unit 64 then starts the time counting with use of an averaging timer for counting the execution time of the averaging of the effective power values (Step S41 in FIG. 11).

The apparatus condition table shown in FIG. 12 defines timer coefficients relating to environmental factors, and timer coefficients relating to temperature-adjustment factors. Each of the timer coefficients relating to the environmental factors defines an execution time of the averaging processing in correspondence to a fixing temperature as the surface temperature of the heating roller 41 that has been changed according to an environmental factor (such as the ambient temperature and the humidity) of the installation environment of the apparatus. Each of the timer coefficients relating to the temperature-adjustment factors defines an execution time of the averaging processing in correspondence to an effective power corresponding to a setting power value W1 that has been changed by the temperature adjustment for adjusting the fixing temperature of the heating roller 41.

According to the apparatus condition table shown in FIG. 12, a timer coefficient "Na" is set when the fixing temperature is lower than a predetermined temperature Ta ("Fixing temperature<Ta"). Similarly, a timer coefficient "Nb" is set when "Ta≤Fixing temperature<Tb", a timer coefficient "Nc" is set when "Tb≤Fixing temperature<Tc" and a timer coefficient "Nd" is set when "Td≤Fixing temperature". Here, Ta<Tb<Tc<Td is satisfied. Also, Na, Nb, Nc, Nd are positive integers satisfying Na<Nb<Nc<Nd.

Also, according to the apparatus condition table shown in FIG. 12, in the case the fixing effective power value determined by the fixing power determining unit 45 is changed due to a temperature-adjustment factor, a timer coefficient "Ma" is set when the change of the fixing effective power value is smaller than Qa ("Fixing power change<Qa"). Similarly, a timer coefficient "Mb" is set when "Qa≤Fixing power change<Qb", a timer coefficient "Mc" is set when "Qb≤Fixing power change<Qc" and a timer coefficient "Md" is set when "Qd≤Fixing power change". Here, Qa<Qb<Qc<Qd is satisfied. Also, Ma, Mb, Mc, and Md are positive integers satisfying Ma<Mb<Mc<Md.

The fixing temperature, which is the surface temperature of the heating roller 41, changes not only due to changes of the environment, but also due to changes of the rotation speed of the heating roller 41. The effective power calculating unit 63*d* acquires the fixing temperature detected by the fixing temperature sensor 44, and acquires a timer coefficient Nx (x is a, b, c or d) shown in the apparatus condition table of FIG. 12 based on the acquired fixing temperature. Also, the effective power calculating unit 63*d* acquires a timer coefficient Mx shown in the apparatus condition table of FIG. 12 based on the fixing power output from the fixing power determining unit 45. If both the fixing temperature and the fixing power value have been changed, the effective power calculating unit 63*d* acquires both the timer coefficients Nx and Mx, and set "Nx×Mx" to the timer value n.

After the timer value n is set and the averaging timer starts timing, the effective power calculating unit 63*d* sequentially calculates effective power values W0 based on instantaneous values P, and inputs them into the induction heating power control unit 64. Note that a $K^{th}$ effective power value W0 is hereinafter referred to as "W0*k*". Every time an effective power value W0*k* is input, the induction heating power control unit 64 stores the effective power value W0*k* into a storage unit (Step S42). The induction heating power control unit 64 then performs the averaging processing to obtain the average of the effective power values W01 to W0*k*, and updates the effective power value W0 to be the average effective power value obtained through the averaging processing (Step S43).

In this way, the averaging processing is repeated every time an effective power value W0 is calculated, until the averaging timer has counted to the set timer value n (Step S44). When the time counted by the averaging timer reaches the timer value n, the induction heating power control unit 64 generates a control signal for resolving the difference from the setting power value W1 as explained above, based on the average effective power value W0, which is the average of the effective power values W01 to W0*k* calculated over k times until the time counted by the averaging timer reaches the timer value n. Then the induction heating power control unit 64 outputs the control signal to the switching circuit 62.

In such averaging processing on the effective power values, the time for the averaging processing increases as the surface temperature of the heating roller 41 as the fixing temperature increases and as the fixing voltage change increases. As the timer required for the averaging increases, the number of times the calculation of the effective power value based on the instantaneous value is performed increases, and accordingly the number of times the effective power sampling is performed increases. As the fixing temperature increases, and as the fixing voltage change increases, the possibility of the occurrence of the waveform distortion of the input alternating current increases. However, the stated structure suppresses the influence of an error due to waveform distortion, if included in the calculated effective power value, by increasing the time for the averaging of the effective power value, and thereby increasing the number of times the effective power sampling is performed.

There is a high possibility of the occurrence of waveform distortion of the input alternating current when the voltage change is large or when the fixing temperature of the heating roller 41 is high. For example, in the case of performing the fixing to a piece of cardboard as a recording sheet with the fixing device 40, the fixing temperature increases as the rotation speed of the heating roller 41 decreases. Even in such a case, the stated structure surely suppresses the influence of an error due to waveform distortion, if included in the sampled effective power value, by setting a long time as the time for the averaging of the effective power value, and thereby increasing the number of times the effective power sampling is performed.

Similarly, in any of the following cases, the fixing temperature is low, because the fixing operation by the fixing device 40 has not been performed: when the electromagnetic induction heating power source 60 comes into the ON state from the OFF state; when the image forming apparatus comes into the power ON state from the power OFF state or comes into the active state from the standby state; and when the image processor executes image stabilization, for example. To increase the fixing temperature to a predetermined setting temperature, it is necessary to apply a high effective power to the electromagnetic induction coil 43.

Also, when the fixing temperature is abnormally high, it is necessary to quickly decrease the fixing power to stop the heating by the electromagnetic induction coil 43.

Thus, in such cases, the power applied to the electromagnetic induction coil 43 considerably changes, and accordingly the possibility of the occurrence of the waveform distortion of the alternating current increases. However, since the power applied to the electromagnetic induction coil 43 considerably changes, the time for the averaging processing on the effective power values is set to be long. As a result, the number of times the effective power sampling is performed is increased. Thus, even if an error due to waveform distortion is included in the calculated effective power value, it is possible to surely suppress the influence of the error. Consequently, even if the fixing temperature or the power applied to the electromagnetic induction coil 43 changes, it is possible to accurately detect the power output to the electromagnetic induction coil 43, and it is possible to precisely control the temperature of the heating roller 41 to be a predetermined fixing temperature.

In the explanation above, the time for calculating the effective power value is determined beforehand, and the averaging processing is performed on the effective power values calculated for the predetermined time. However, the number of times the calculation of the effective power value is performed (i.e. the number of samplings) may be determined beforehand, and the averaging processing may be performed on the effective power values detected over the predetermined number of samplings.

Also, in the case the fixing temperature as the detected surface temperature of the heating roller 41 or the power output from the electromagnetic induction coil 43 is changed, the averaging of the calculated effective power values is not necessarily performed. That is, in such a case, the coefficient k in the Expression (2) may be changed based on the fixing temperature that has been changed or on the change of the setting power value. Also, whether to perform the averaging of the calculated effective power values may be determined based on the change of the fixing temperature. For example, the averaging may be performed only when Fixing temperature<Ta, or Tc≤Fixing temperature is satisfied, and not performed in the other cases. Similarly, whether to perform the averaging of the calculated effective power values may be determined based on the change of the power output to the electromagnetic induction coil 43.

Furthermore, although a heating roller on which an electromagnetic induction heating layer is formed is used as a first roller, the present invention is not limited to this. For example, a fixing belt on which an electromagnetic induction heating layer is formed may be used instead of the heating roller. In the case a fixing belt is used, high-speed control is required because the thermal capacity of a fixing belt is low. However, application of the present invention realizes high-speed control. Also, a pressure belt may be used instead of the pressure roller.

The image forming apparatus to which the fixing device pertaining to the present invention is applied is not limited to a tandem-type color digital printer. It can be, for example, a so-called four-cycle type image forming apparatus or a monochrome image forming apparatus. Also, the fixing device of the present invention can be applied to copiers, facsimiles, MFPs (Multiple Function Peripheral), and the like, in addition to printers.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

INDUSTRIAL APPLICABILITY

The present invention enables a fixing device that uses electromagnetic induction heating technology to quickly and stably control the power output to the electromagnetic induction coil by quickly detecting the power of an alternating current input to an electromagnetic induction heating power source.

What is claimed is:

1. A fixing device for fixing an unfixed image formed on a recording sheet by causing an electromagnetic heating layer of a first roller to generate heat by using a magnetic flux generated from an electromagnetic induction coil and applying the generated heat to the unfixed image while the recording sheet is passing through a fixing nip formed between the first roller and a second roller pressed against the first roller, the fixing device comprising:

an electromagnetic induction heating power source operable to generate high-frequency power by rectifying a commercial-use alternating current and performing high-speed switching on the rectified current by using a switcher, and to output the high-frequency power to the electromagnetic induction coil;

a temperature detector operable to detect a surface temperature of the first roller; and an output power determiner operable to determine a desired value of the high-frequency power based on the surface temperature detected by the temperature detector, wherein the electromagnetic induction heating power source includes:

a power detector operable to detect information relating to the alternating current based on an instantaneous power value of the alternating current measured only at a time point that is a predetermined period after a zero cross timing of power of the alternating current; and an induction heating power source controller operable to control the switcher based on the information detected by the power detector, such that the high-frequency power has the desired value.

2. The fixing device of claim 1, wherein the predetermined period corresponds to a quarter of a cycle of the alternating current.

3. The fixing device of claim 1, wherein the power detector detects the zero cross timing based on a voltage value or a current value of the alternating current, and the induction heating power source controller calculates the instantaneous power value of the alternating current based on an instantaneous voltage value or an instantaneous current value of the alternating current measured at the time point.

4. The fixing device of claim 1, wherein the power detector calculates an effective power value of the alternating current based on the instantaneous power value.

5. The fixing device of claim 4, wherein the power detector calculates the effective power value by W0=k.times.P, where W0 is the effective power value, P is the instantaneous power value and k is a predetermined coefficient.

6. The fixing device of claim 4, wherein the induction heating power source controller detects a plurality of instantaneous power values of the alternating current, and calculates the effective power value by performing averaging processing on a plurality of effective power values respectively calculated based on the plurality of instantaneous power values.

7. The fixing device of claim 6, wherein the induction heating power source controller performs the averaging processing for a predetermined execution period.

8. The fixing device of claim 7, wherein the induction heating power source controller judges whether to perform the averaging processing based on the surface temperature detected by the temperature detector.

9. The fixing device of claim 8, wherein the induction heating power source controller increases the predetermined execution period as the surface temperature detected by the temperature detector increases.

10. The fixing device of claim 6, wherein the induction heating power source controller judges whether to perform the averaging processing based on the desired value of the high-frequency power determined by the output power determiner.

11. The fixing device of claim 10, wherein in a case of performing the averaging processing, the induction heating power source controller increases the predetermined execution period as a fluctuation of the desired value of the high-frequency power determined by the output power determiner increases.

12. The fixing device of claim 6, wherein the induction heating power source controller performs the averaging processing on the plurality of effective power values acquired over a predetermined number of sampling processes.

13. An image forming apparatus for fixing an unfixed image formed on a recording sheet by applying heat to the unfixed image by using a fixing part, comprising the fixing device of claim 1 as the fixing part.

* * * * *